US007374701B2

(12) United States Patent
Hwang et al.

(10) Patent No.: US 7,374,701 B2
(45) Date of Patent: May 20, 2008

(54) ORGANOMETALLIC PRECURSOR COMPOSITION AND METHOD OF FORMING METAL FILM OR PATTERN USING THE SAME

(75) Inventors: Euk Che Hwang, Gyeonggi-Do (KR); Sang Yoon Lee, Seoul (KR); Young Hun Byun, Daejeon-Si (KR); Joon Sung Ryu, Incheon-Si (KR); Hae Jung Son, Suwon-Si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 546 days.

(21) Appl. No.: 10/874,284

(22) Filed: Jun. 24, 2004

(65) Prior Publication Data

US 2005/0084689 A1 Apr. 21, 2005

(30) Foreign Application Priority Data

Jun. 30, 2003 (KR) ..... 10-2003-0043564

(51) Int. Cl.
*H01B 1/00* (2006.01)
*H01B 1/12* (2006.01)

(52) U.S. Cl. ..... 252/500; 106/287.1; 427/252; 427/558; 438/650

(58) Field of Classification Search ..... 252/500; 427/243, 533, 558, 252; 428/446; 106/287.1; 438/650; 556/136–137
See application file for complete search history.

(56) References Cited

U.S. PATENT DOCUMENTS

| | | | | |
|---|---|---|---|---|
| 4,186,244 | A | 1/1980 | Deffeyes et al. | |
| 4,463,030 | A | 7/1984 | Deffeyes et al. | |
| 4,598,056 | A * | 7/1986 | Barraud et al. | 502/4 |
| 5,064,685 | A * | 11/1991 | Kestenbaum et al. | 427/556 |
| 5,130,172 | A * | 7/1992 | Hicks et al. | 427/584 |
| 5,173,330 | A | 12/1992 | Asano et al. | |
| 5,204,313 | A * | 4/1993 | Lelental et al. | 505/446 |
| 5,360,635 | A * | 11/1994 | Richards et al. | 427/243 |
| 5,534,312 | A * | 7/1996 | Hill et al. | 427/533 |
| 5,882,722 | A | 3/1999 | Kydd | |
| 6,036,889 | A | 3/2000 | Kydd | |
| 6,599,587 | B2 * | 7/2003 | Chung et al. | 427/558 |
| 6,774,034 | B2 * | 8/2004 | Byun et al. | 438/650 |
| 7,084,288 | B2 * | 8/2006 | Son et al. | 556/137 |
| 2004/0010158 | A1 * | 1/2004 | Meiere et al. | 556/136 |
| 2004/0219369 | A1 * | 11/2004 | Garg et al. | 428/446 |

OTHER PUBLICATIONS

Vogel et al., Angewandte Chemie International Edition in English, vol. 30, No. 3, pp. 303-304 (1991).*

* cited by examiner

*Primary Examiner*—Mark Kopec
*Assistant Examiner*—Khanh Tuan Nguyen
(74) *Attorney, Agent, or Firm*—Harness, Dickey & Pierce, P.L.C.

(57) ABSTRACT

A composition of (i) an organometallic precursor containing a hydrazine compound coordinating with a central metal thereof and (ii) an organometallic compound of a main group metal and a method of forming metal film or pattern using this composition.

25 Claims, 3 Drawing Sheets

(a) (b)

ORGANOMETALLIC PRECURSOR COMPOSITION AND METHOD OF FORMING METAL FILM OR PATTERN USING THE SAME

BACKGROUND OF THE INVENTION

This non-provisional application claims priority under 35 U.S.C. 119(a) on Patent Application No. 2003-43564 filed in Korea on Jun. 30, 2003, which is herein incorporated by reference.

1. Field of the Invention

The present invention relates to an organometallic precursor composition and a method of forming a metal film or pattern using the same. More specifically, the present invention relates to a composition comprising (i) an organometallic precursor containing a hydrazine compound coordinating to a central metal thereof and (ii) an organometallic compound of a main group metal and a method of forming a metal film or pattern using the composition.

2. Description of the Related Art

A metal pattern to be formed on a substrate continues to get smaller in accordance with the recent trend of an increase in the degree of integration and a decrease in the size of electronic devices, such as integrated circuits (IC) and Liquid crystalline displays. Usually, metal patterns are formed on a substrate through a photolithography process using a photoresist and generally include the steps of a) forming a metal layer on a substrate via a chemical vapor deposition process (CVD process), a plasma deposition process or an electrical plating process; b) coating a photoresist on the metal layer; c) exposing the coated photoresist to UV-radiation under a photomask having a pattern; d) developing the photoresist layer to obtain a patterned photoresist layer; and e) etching the metal layer under the pattern of the photoresist with, for example, a reactive ion-etching process to form a metal pattern on the substrate. Since the photolithography process involves many complicated steps and requires the use of a large amount of fine chemicals such as expensive photoresist compositions and etchants, it is undesirable in terms of cost and environmental protection. Especially, in the photolithography process, there are many steps such as depositing or etching that should be conducted at a high temperature and/or high pressure, and thus, the operational costs become very high. Also, metal vapor diffusion into the substrate, which frequently occurs under a high temperature process, brings about a malfunction or defect in the final electronic device. On the other hand, for a flexible display or a TFT-LCD to achieve a high quality picture and a large-scaled screen, technology is urgently required for developing a gate dielectric layer of high quality and a source/drain electrode region with low resistance. Under these circumstances, many studies have been made on the formation of a metal film or pattern through a simple procedure at a relatively low temperature.

As an alternative technology for the photolithography process, soft-lithography and ink-jet printing draw attention because they form a very fine pattern on a substrate through relatively simplified procedures requiring low operational costs. However, these two technologies still have the problems that a film or a pattern obtained should be heat-treated, or additionally oxidized or reduced at a high temperature in order for the film or pattern thus obtained to have a lower resistivity. But considering the materials currently used for the substrate, a heat treatment at high temperatures is not advantageous so there remains a need to develop a novel ink which allows the formation of a metal pattern with high durability and high conductivity at a high resolution via a more simplified process requiring a low temperature.

In this regard, IEEE Transactions on component Hybrids and Manufacturing Technology 12(4), 1987 ("Liquid ink-jet printing with MOD inks for hybrid microcircuits", Teng, K. F. and Vest, R. W.) discloses organometallic compounds that can be thermally decomposed at low temperatures and converted into metals or metal oxides, i.e., so-called metallo-organic decomposition (MOD) compounds, and U.S. Pat. No. 5,882,722 discloses a technology of forming a metal film or pattern using these MOD compounds. However, this technology has the drawback that the metal film or pattern thus formed tends to melt before thermal-decomposition so it is very difficult to secure the required thickness of the metal film or pattern. Also, the resistivity of the metal film or pattern thus obtained is quite high. To avoid these problems, multiple coating has been proposed as an alternative, but it is not preferable because multiple coating entails many complicated steps and high costs. U.S. Pat. No. 5,173,330 discloses a method using organometallic precursors to form a thin metal film or nuclei that is normally used in an electrolytic plating process but this method is undesirable because of the low conductivity of the obtained film or pattern. Further, U.S. Pat. Nos. 4,186,244 and 4,463,030 disclose a process of forming a metal film at a low temperature by using silver (Ag) powder and a surfactant wrapping the silver powder. However, this process is disadvantageous in that, after formation, the metal film should be exposed to a high temperature of 600° C. or higher in order to remove the surfactant. If the metal film is not exposed to this high temperature, the specific resistivity of the metal film becomes undesirably high because of organic materials remaining on the metal film.

In addition, U.S. Pat. No. 6,036,889 discloses a process of forming a highly conductive metal pattern with a specific resistivity of about 3.0 $\mu\Omega cm^{-1}$ on a polymer substrate at the low temperatures of 350° C. or lower using a mixture of MOD compounds, metal flakes and metal colloid. In the mixture, the MOD compounds lowers the required temperature for the heat treatment and facilitates the formation of a coating on the substrate, while the metal flakes promote the solidification of a precursor so as to prevent the MOD compounds from melting before the formation of a metal film. This process attempts to overcome the problems in the prior art by using a multi-component mixture, in which one compound helps avoid the problems of other compounds so as to obtain a metal pattern with excellent properties. However, there is a limitation in improving the properties of the metal pattern because this process does not address the fundamental problems in the prior art and every component in the mixture has its upper limit in its content. Hence, it is impossible to form a metal film or pattern with a high conductivity corresponding to a pure metal at a temperature of 250° C. or lower through this process.

On the other hand, as a highly integrated circuit is developed, an extremely fine metal pattern is required. In such a pattern, poor adhesion or surface morphology may result in serious problems such as disconnection of the circuit. Thus these characteristics are important.

Therefore, there remains a need to develop a method of forming a metal film or pattern with high conductivity corresponding to that of a pure metal and a desired thickness via a simple procedure using a relatively low temperature, wherein the film or pattern thus obtained shows both an excellent adhesion and a good surface morphology.

The present inventors have conducted extensive studies and have found that a highly conductive metal film or pattern having a specific resistivity of 2.5 to 3.0 $\mu\Omega cm^{-1}$, an excellent adhesion and a good surface morphology can be obtained through a simple procedure at a relatively low temperature, by using a composition comprising (i) an organometallic precursor containing a hydrazine compound coordinating to a central metal thereof and (ii) an organometallic compound of a main group metal, such as Si, Ge, Sn or Bi.

SUMMARY OF THE INVENTION

Therefore, according to a feature of the present invention, there is provided a composition for forming a metal film or pattern, which comprises (i) an organometallic precursor represented by the following Formula 1 and (ii) an organometallic compound of a main group metal:

$$L_nM_mL'_pX_q \qquad \text{Formula 1}$$

wherein,

M is a transition metal;

L' is a neutral ligand;

X is an anion that may or may not coordinate to the transition metal;

m is an integer of 1 to 10, provided that when m is two or more, each M is independently the same or different;

n is an integer of 1 to 40, provided that when n is two or more, each L is independently the same or different;

p is an integer of 0 to 40;

q is an integer of 0 to 10, provided that when p or q is two or higher, each L' or each X is independently the same or different, and p and q are not zero at the same time; and L is a hydrazine compound coordinating to the transition metal, represented by the following Formula 2:

$$R_1R_2NNR_3R_4 \qquad \text{Formula 2}$$

wherein, $R_1$, $R_2$, $R_3$ and $R_4$ are independently hydrogen, $C_1$~$C_{20}$ alkyl group, $C_1$~$C_{20}$ aryl group, or

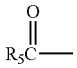

[in which, $R_5$ is R', $R'_2N$, or R'O (wherein R' is hydrogen, or $C_1$~$C_{20}$ alkyl or aryl group)], provided that the alkyl and aryl group may or may not have one or more substituent which is selected from the group consisting of halogen, amine group, —OH, —SH, —CN, —$SO_3H$, $R_6S$—, $R_6O$—,

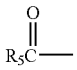

and nitrile groups (in which, $R_5$ is defined as above and $R_6$ is $C_1$~$C_{20}$ alkyl or aryl group).

According to another feature of the present invention, there is provided a method of forming a metal film or pattern comprising the steps of (i) preparing a solution of the composition; (ii) forming a film or pattern with the solution; and (iii) heating the film or pattern to obtain a metal film or pattern.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other features and advantages of the invention will become apparent and more readily appreciated from the following description of the preferred embodiments, taken in conjunction with the accompanying drawings wherein:

FIG. 3(*b*) is an electron microphotograph of the surface of a metal film treated in air condition obtained from Comparative Example 3;

DETAILED DESCRIPTION OF THE INVENTION

Figure 1:
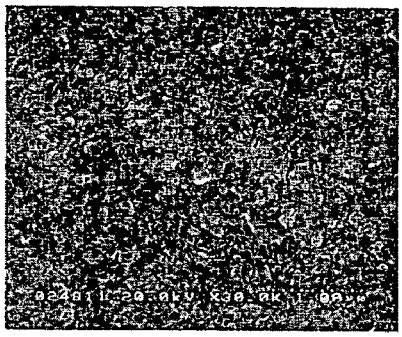
FIG. 1 is an electron microphotograph of a metal thin film obtained by Example 1.

A more detailed description of the present invention will be given, below. In this specification, the term "metal" means not only substantially pure metal but also metal oxide.

The inventive composition of an organometallic precursor for forming a metal film or pattern comprises (i) organometallic precursor represented by the following Formula 1 and (ii) an organometallic compound of a main group metal:

$$L_nM_mL'_pX_q \qquad \text{Formula 1}$$

wherein,

M is a transition metal;

L' is a neutral ligand;

X is an anion that may or may not coordinate to the transition metal;

m is an integer of 1 to 10, provided that when m is two or more, each M is independently the same or different;

n is an integer of 1 to 40, provided that when n is two or more, each L is independently the same or different;

p is an integer of 0 to 40;

q is an integer of 0 to 10, provided that when p or q is two or higher, each L' or each X is independently the same or different, and p and q are not zero at the same time; and L is a hydrazine compound coordinating to the transition metal, represented by the following Formula 2:

$$R_1R_2NNR_3R_4 \qquad \text{Formula 2}$$

wherein, $R_1$, $R_2$, $R_3$ and $R_4$ are independently hydrogen, $C_1$~$C_{20}$ alkyl group, $C_1$~$C_{20}$ aryl group, or

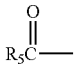

[in which, $R_5$ is R', $R'_2N$, or R'O (wherein R' is hydrogen, or $C_1$~$C_{20}$ alkyl or aryl group)], provided that the alkyl and aryl group may or may not have one or more substituent which is selected from the group consisting of halogen, amine group, —OH, —SH, —CN, —$SO_3H$, $R_6S$—, $R_6O$—,

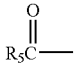

and nitrile groups (in which, $R_5$ is defined as above and $R_6$ is $C_1$~$C_{20}$ alkyl or aryl group).

In the composition of the present invention, the ratio of the component (ii), i.e. the organometallic compound of a main group metal, ranges from 0.01 to 10 parts by mole based on 100 parts by mole of the metal in the component (i) of the organometallic precursor. In case of the ratio of the component (ii) is less than 0.01 part by mole, improvement in adhesion and surface morphology is hardly expected, while in case that the ratio of the component (ii) exceeds 10 parts by mole, the specific resistivity becomes undesirably high and the film or pattern becomes too thick.

In the present invention, the organometallic precursor of Formula 1 is a type of MOD compound, which is converted into pure metal or metal oxide through reduction of the central metal and decomposition of the organic compound. By a presence of one or more hydrazine ligand, the organometallic precursor of the present invention can be decomposed at a lower temperature and be readily reduced so heat treatment without using any reducing agent allows both decomposition and reduction reactions of the precursor to proceed with high yield to obtain the metal or metal oxide of high purity.

In Formula 1, metal M is preferably selected from the group consisting of Ag, Au, Cu, Pd, Pt, Os, Rh, Co, Ni, Cd, Ir and Fe, and more preferably, M is Ag, Au or Cu. Also, L', a neutral ligand bonded to the metal M, is an organic compound containing a donor atom such as N, P, As, O, S, Se or Te. Preferably, L' is a compound having 20 or fewer carbons containing the donor atom and more preferably, L' is selected from the group consisting of amines, alcohols, phospines, phospites, phospine oxides, arsines, thiols, carbonyl compounds, alkenes, alkyns and arenes. Specific examples for L' include, but are not limited to, acetonitrile, isopropyl alcohol and propyl amine.

X is an anion that functions to electrically neutralize the metal compound, and may coordinate with a metal atom. More specifically, X is an anion including 20 or fewer carbons and at least one atom selected from the group consisting of O, N, S, P, F, Cl, Br, I, Sb, B, As, Bi, Si and Sn. Examples of X include, but are not limited to, $OH_-$, $CN_-$, $NO_2^-$, $NO_3^-$, halides ($F^-$, $Cl^-$, $Br^-$ or $I^-$), trifluoroacetate, isothiocyanate, tetraalkylborate ($BR_4^-$, in which R is methyl, ethyl or phenyl group), tetrahaloborate ($BX_4^-$, in which X is F or Br), hexafluorophosphate ($PF_6^-$), triflate ($CF_3SO_3^-$), tosylate ($Ts^-$), sulphate ($SO_4^{2-}$), carbonate ($CO_3^{2-}$), acetylacetonate, hydrazino benzoic acid ($CO_2C_6H_4NHNH_2^-$) and trifluoroantimonate ($SbF_6^-$). When the anion contains a hydrazine group as hydrazine benzoic acid, decomposition and reduction characteristics of the organometallic precursor can be preferably improved.

Furthermore, in the Formula 1, when n, p, or q is two or more, each of L, L', or X may or may not be the same as each other, and when there are two or more metals, L, L' or X may be used as the ligand connecting the metals to each other.

Examples of the organometallic precursor compound represented by Formula 1 include $Ag(CF_3COO)CH_3CONHNH_2$, $Ag(CF_3COO)$t-butylcarbazate, $Ag(CF_3COO)$benzoichydrazide, $Ag(BF_4)CH_3CONHNH_2$, $Ag(SbF_6)CH_3CONHNH_2$, $Ag(SO_3CF_3)CH_3CONHNH_2$, and $Ag(NO_3)CH_3CONHNH_2$. Examples of the hydrazine compound represented by Formula 2 include acetic hydrazide, t-butylcarbazate and benzoichydrazide.

The organometallic precursor of the Formula 1 can be prepared by the following steps: After the organometallic compound having the general formula of $M_mL'_pX_q$ (M, L', X, m, p, q is as defined in Formula 1) is dissolved in an organic solvent, a solution of the hydrazine compound of Formula 2 in the same or different solvent is added dropwise to the solution of the organometallic compound, and agitated at room temperature. From the resulting mixture, the solvent is then removed to produce the organometallic compound of Formula 1. Non-limiting, illustrative examples of the solvent include acetonitrile, isopropyl alcohol and methanol.

Figure 5:
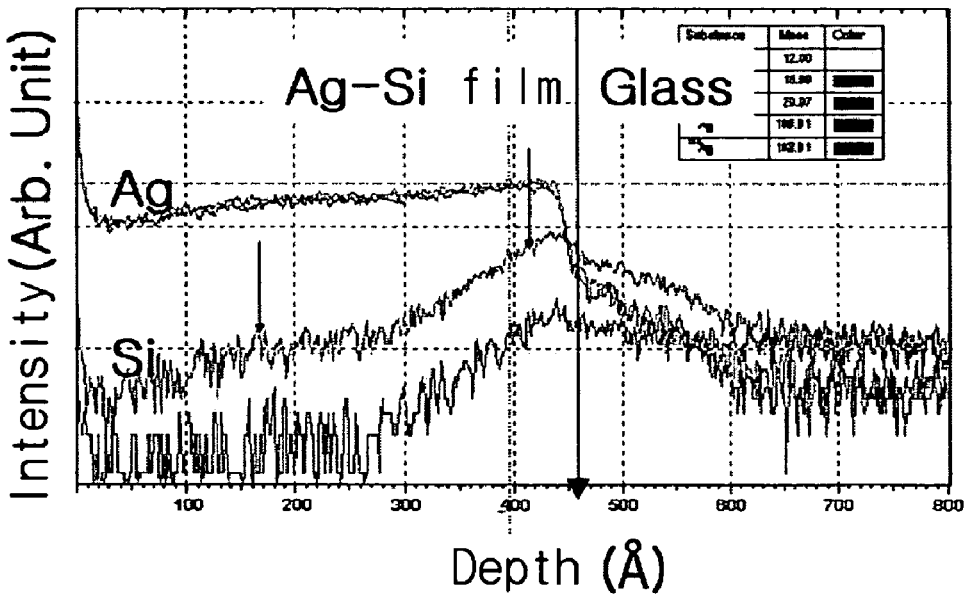
FIG. 5 is a depth profile photograph of the metal film obtained from Example 1.

Organometallic compounds of the main group metal which is one of the important components, is preferably an organometallic compound of $C_1$~$C_{30}$ including Si, Ge, Sn or Bi. The organometallic compound of the main group metal may contain a functional group including N, O, S, P or halogen atom (F, Cl, Br and I), such as amines, esters, thioesters, and alkoxy and mercapto groups. The organometallic compound of the main metal group can be provided as a homogeneous solution in a variety of organic solvents and as well, functions to improve the adhesion and surface morphology of the film or pattern thus obtained while maintaining the resistivity of the film or pattern at a low level. According to the present invention, a pattern or film prepared on a substrate from the composition shows highly-improved adhesion and excellent surface morphology as shown in FIG. 5 and these improvements are thought to result from the main group metal existing between the metal and the substrate. Preferable examples of the organometallic compound of the main group metal include, but are not limited to, $(RO)_3Si(CH_2)_nNH_2$ (in which R is methyl or ethyl group; and n is an integer of 1 to 10), tin(II)2-ethylhexanoate, germanium(IV)alkoxide and bismuth(III) acetate.

A process for forming a film by using the composition of the present invention includes the steps of (i) preparing a solution of the composition of the present invention by dissolving it in a suitable solvent; (ii) forming a film on the substrate; and (iii) heat-treating the film. In this method, if necessary, UV irradiation can be added after step (ii) of the film formation and before step (iii) of the heat treatment, resulting in decreasing the size of the crystal and the roughness of the surface. The UV irradiation can be performed by using UV light with 200-700 nm of wavelength, or by using the light source of i-line, g-line or h-line, for 5 sec to 10 min, preferably.

A process for forming a metal pattern by using the composition of the present invention includes the steps of (i) preparing a solution of the composition of the present invention by dissolving it in a suitable solvent; (ii) directly forming a pattern using the solution; and (iii) heat-treating the pattern to form a metal pattern. In this method, if necessary, UV irradiation can be added after step (ii) of the pattern formation and before step (iii) of the heat treatment, resulting in improving surface morphology. The conditions of UV irradiation are the same as described above.

Alternatively, the process includes the steps of (i) preparing a solution of the composition of the present invention by dissolving it in a suitable solvent; (ii) forming a film on the substrate; (iii) partially heat-treating the film with IR, UV, laser or E-beam, under a patterned mask; and (iv) developing the film to form a pattern.

In step (i), the organic solvent can be exemplified by, but are not limited to, nitrile-based solvent such as acetonitrile, propionitrile, pentanenitrile, hexanenitrile, heptanenitrile and isobutylnitrile; aliphatic hydrocarbon solvent such as hexane, heptane, octane and dodecane; aromatic hydrocarbon solvent such as anisole, mesitylene and xylene; ketone-based solvent such as methyl isobutyl ketone, 1-methyl-2-pyrrolidinone, cyclohexanone and acetone; ether-based solvent such as tetrahydrofuran, diisobutyl ether and isopropyl ether; acetate-based solvent such as ethyl acetate, butyl acetate and propylene glycol methyl ether acetate; alcohol-based solvent such as isopropyl alcohol, butyl alcohol, hexyl alcohol and octyl alcohol; inorganic solvent; and a mixture thereof.

In step (ii), the substrate can be made of inorganic materials such as silicon and glass; organic materials such as plastic; or composite materials comprising organic and inorganic matter.

In the present invention, coating of the substrate with the coating solution can be accomplished, for example, through spin coating, roll coating, dip coating, spray coating, flow coating or screen printing, while spin coating is most preferred.

The organometallic precursor composition according to the present invention can be applied to any known patterning process and, especially, to soft lithography, imprinting, ink-jet printing, silk-screen, and a direct patterning method utilizing an electromagnetic wave (a laser beam, an e-beam, or UV).

The "soft lithography" includes microcontact printing, microtransfer printing, micromolding in capillary (MIMIC), and solvent-assistance micromolding and, in these processes, patterns of organic compounds are transferred onto a substrate using an elastomeric stamp or mold with fine patterns (Younan Xia et al., *Angew. Chem. Int. Ed.* 1998, 37, 550-575).

The coating film or pattern of the organometallic precursor composition on the substrate is heat-treated at a maximum temperature of 500° C., preferably at a temperature of 250° C. or lower. Further, the heat-treatment can be divided between a soft-baking process conducted at a temperature of 200° C. or lower (preferably, at a temperature of 80 to 150° C.), and an annealing process conducted at a temperature of 200 to 400° C.

According to the present invention, the organometallic precursor contains the hydrazine compound that has excellent reducing ability and is activated at a relatively low temperature, so that when being subjected to the heat-treatment, the hydrazine ligand activated by the heat-treatment reduces a central metal and, at the same time, promotes the decomposition of the organometallic precursor, whereby the organic portion of the organometallic compound is decomposed and removed, and a pure metal portion is obtained. Because of the introduction of the hydrazine compound as a ligand, reduction of the central metal can be performed efficiently without any other reducing agent, and the temperature at which decomposition begins is significantly lowered, whereby a heat treatment at a relatively low temperature can produce a highly conductive, pure metal film. As described above, the organometallic precursor of the present invention is simultaneously decomposed and reduced by the heat-treatment at a low temperature, so it is relatively easy for a coated film or a formed pattern to have a desired thickness by controlling the concentration of the solution of the organometallic precursor and thereby conventional problems about controlling the film thickness, i.e. difficulties in securing the thickness of the coated film or formed pattern resulting from melting during the heat-treatment of MOD is avoided. The heat-treatment may be conducted under nitrogen, a vacuum, or air atmosphere. In case of using the organometallic precursor composition of the present invention, it is very advantageous that a very pure metal film with high conductivity can be formed irrespective of the atmospheric conditions and also that the adhesion and morphology of the metal film and the pattern thus obtained are excellent. In addition, if the UV irradiation process is added to the above method before the heat-treatment, a more excellent morphology of the surface can be obtained.

The developing solution used in the present invention can be every solution that is used in preparation of the composition according to the present invention, but is not specially limited to this range.

The present invention can be more clearly understood with referring to the following examples. It should be understood that the following examples are not intended to restrict the scope of the present invention in any manner.

PREPARATION EXAMPLES

Synthesis of Organometallic Precursor Compounds

All compounds used in the present invention are synthesized under a nitrogen atmosphere without humidity or oxygen according to a Schlenk technology or a Glove box technology.

1) Synthesis of $Ag(CF_3COO)CH_3CONHNH_2$

In a 50 ml round Schlenk flask, 2.209 g (10.000 mmol) of silver trifluoroacetate ($Ag(CF_3COO)$) is dissolved in 20 ml of acetonitrile (MeCN), and, to the resulting solution, 0.781 g (10.000 mmol) of acetichydrazide ($CH_3CONHNH_2$) dissolved in acetonitrile is added dropwise. The resulting mixture is agitated at room temperature for 15 minutes, and the solvent is evaporated under a reduced pressure for three to four hours. The $^1$H-NMR spectrum of the resulting product is shown below.

$^1$H-NMR($CD_3CN$, ppm): 9.27 [s, 1H, —$CH_3CON$—$\underline{H}$], 4.79 [s, 2H, —NHN—$\underline{H}_2$], 1.83 [s, 3H, —$NHCOC\underline{H}_3$]

2) Synthesis of $Ag(CF_3COO)$t-butylcarbazate

The procedure of Preparation Example 1) is repeated to produce $Ag(CF_3COO)$t-butylcarbazate, except that 1.322 g (10.000 mmol) of t-butylcarbazate is used instead of acetichydrazide. The $^1$H-NMR spectrum of $Ag(CF_3COO)$t-butylcarbazate is shown below.

$^1$H-NMR($CD_3CN$, ppm): 7.72 [s, 1H, —OCON—$\underline{H}$], 4.59 [s, 2H, —NHN—$\underline{H}_2$], 1.44 [s, 9H, —$NHCOOC(C\underline{H}_3)_3$]

3) Synthesis of $Ag(CF_3COO)$benzoichydrazide

The procedure of Preparation Example 1) is repeated to produce $Ag(CF_3COO)$benzoichydrazide, except that 1.362 g (10.000 mmol) of benzoichydrazide is used instead of acetichydrazide. The $^1$H-NMR spectrum of $Ag(CF_3COO)$benzoichydrazide is shown below.

$^1$H-NMR($CD_3CN$, ppm): 9.10[s, 1H, —PhCON—H], 4.61[s, 2H, —NHN—$H_2$], 7.77[d, 2H, —PhCO/2,6H], 7.44 [m, 2H, —PhCO/3, 4, 5H]

4) Synthesis of $Ag(BF_4)CH_3CONHNH_2$

The procedure of Preparation Example 1) is repeated to produce $Ag(BF_4)CH_3CONHNH_2$ except that 1.947 g (10.000 mmol) of silver tetrafluoroborate ($AgBF_4$) is used instead of silver trifluoroacetate. The $^1$H-NMR spectrum of $Ag(BF_4)CH_3CONHNH_2$ is shown below.

$^1$H-NMR($CD_3CN$, ppm): 7.94[s, 1H, —$CH_3$CON—H], 4.24[s, 2H, —NHN—$H_2$], 1.83[s, 3H, —NHCOC$H_3$]

5) Synthesis of $Ag(SO_3CF_3)CH_3CONHNH_2$

The procedure of Preparation Example 1) is repeated to produce $Ag(SO_3CF_3)CH_3CONHNH_2$, except that 2.569 g (10.000 mmol) of silver trifluoromethane sulfonate ($Ag(SO_3CF_3)$) is used instead of silver trifluoroacetate. The $^1$H-NMR spectrum of $Ag(SO3CF_3)CH_3CONHNH_2$ is shown below.

$^1$H-NMR($CD_3CN$, ppm): 8.03[s, 1H, —$CH_3$CON—H], 4.42 [s, 2H, —NHN—$H_2$], 1.82[s, 3H, —NHCOC$H_3$]

6) Synthesis of $Ag(SbF_6)CH_3CONHNH_2$

The procedure of Preparation Example 1) is repeated to produce $Ag(SbF_6)CH_3CONHNH_2$, except that 3.436 g (10.000 mmol) of silver hexafluoroantimonate ($Ag(SbF_6)$) is used instead of silver trifluoroacetate. The $^1$H-NMR spectrum of $Ag(SbF_6)CH_3CONHNH_2$ is shown below.

$^1$H-NMR($CD_3CN$, ppm): 7.82[s, 1H, —$CH_3$CON—H], 4.32[s, 2H, —NHN—$H_2$], 1.82[s, 3H, —NHCOC$H_3$]

7) Synthesis of $Ag(NO_3)CH_3CONHNH_2$

The procedure of Preparation Example 1) is repeated to produce $Ag(NO_3)CH_3CONHNH_2$, except that 1.699 g (10.000 mmol) of silver nitrate ($AgNO_3$) is used instead of silver trifluoroacetate. The $^1$H-NMR spectrum of $Ag(NO_3)CH_3CONHNH_2$ is shown below.

$^1$H-NMR($CD_3CN$, ppm): 9.04[s, 1H, —$CH_3$CON—H], 4.92[s, 2H, —NHN—$H_2$], 1.89[s, 3H, —NHCOC$H_3$]

Example 1

$Ag(CF_3COO)CH_3CONHNH_2$ obtained from Preparation Example 1) and 3-aminopropyl trimethoxy silane are dissolved in MeCN in order to obtain the solution of the composition of following Table 1. The ratio of 3-aminopropyl trimethoxy silane is 2.0 parts by mole to 100 parts by mole of $Ag(CF_3COO)CH_3CONHNH_2$. The solution is spin-coated on a substrate followed by irradiation of UV light using 600 W UV irradiator for 200 sec. The coating film is then heat-treated at 300° C. for 5 min to form a metal film. The morphology of the surface of the film is illustrated in FIG. 1. The thickness and resistivity of the metal film are measured using an alpha-step and a four-point probe and the adhesion is measured using a scratch tester. The results are illustrated in Table 1. The depth profile of the film obtained is illustrated in FIG. 5. From FIG. 1 and Table 1, it can be seen that the film formed from the composition according to the present invention has excellent surface morphology without surface defect, irrespective of the heat-treating conditions. In addition, the adhesion is equal to that of Ag layer formed by sputtering-method.

Example 2

Figure 2:
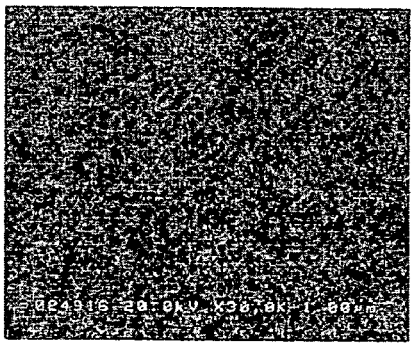
FIG. 2 is an electron microphotograph of a metal thin film obtained by Example 2.

The procedure of Example 1 is repeated to produce a metal film, except that, as an organometallic precursor compound, $Ag(CF_3COO)$t-butylcarbazate obtained from Preparation Example 2) is used and, as a main group metal compound, tin(II)2-ethylhexanoate is used. The morphology of the film is illustrated in FIG. 2 and the thickness, resistivity and adhesion of the film prepared are shown in Table 1. From FIG. 2 and Table 1, it can be seen that the film formed from the composition according to the present invention has the adhesion which is equal to that of Ag layer formed by sputtering-method and which is 3 times better than that of the following Comparative Example 3.

Comparative Example 1

The procedure of Example 1 is repeated to produce a metal film, except that, as an organometallic precursor compound, $Ag(CF_3COO)CH_3CONHNH_2$ obtained from Preparation Example 1) is used and the main group metal compound is not used. The results are shown in Table 1.

Comparative Example 2

The procedure of Example 1 is repeated to produce a metal film, except that, as an organometallic precursor compound, $Ag(CF_3COO)$t-butylcarbazate obtained from Preparation Example 2) is used and the main group metal compound is not used. The results are shown in Table 1.

Comparative Example 3

Figure 3:
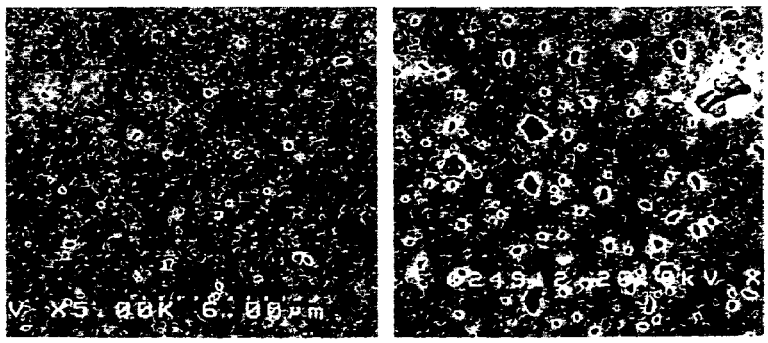
FIG. 3(*a*) is an electron microphotograph of the surface of a metal film treated under vacuum conditions obtained from Comparative Example 3.
Figure 4:
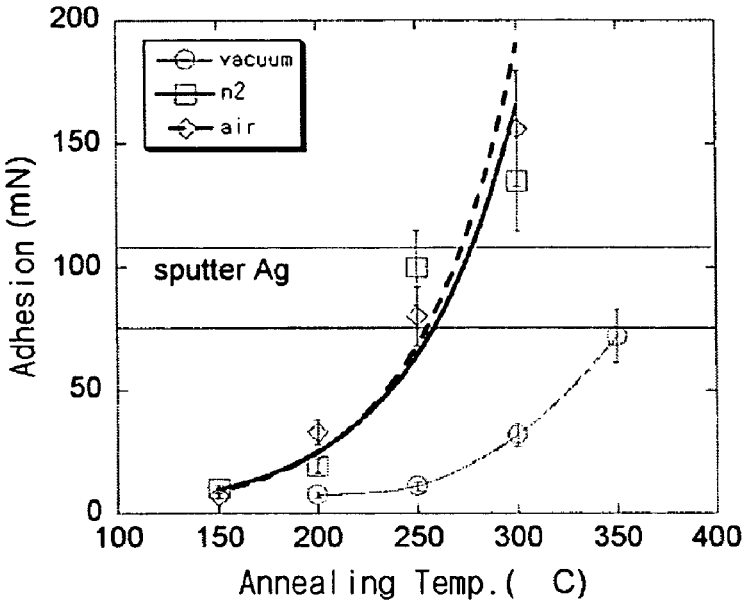
FIG. 4 shows graphs plotting changes in adhesive power of the metal film obtained from Comparative Example 3 by altering the heating conditions and as vacuum, nitrogen and air condition.

Variation of Physical Properties of a Metal Thin Film under Various Atmospheres The procedure of Comparative Example 1 is repeated to produce a metal film, except that heat-treating is performed independently under nitrogen ($N_2$), air atmosphere, and vacuum atmosphere. The morphology of the surface of the film treated under air and vacuum atmosphere are respectively illustrated in FIGS. 3(*a*) and 3(*b*). The adhesion of the films treated under nitrogen ($N_2$), air, and vacuum atmosphere are illustrated in FIG. 4. From FIGS. 3(*a*), 3(*b*) and 4, in the case of treatment under an air atmosphere, many defects such as pin holes occur but adhesion is enhanced. In the case of treatment under a vacuum atmosphere, on the other hand, the defects are remarkably decreased but adhesion is very bad.

TABLE 1

| | Organometallic Precursor Compound | Main Group Metal Compound | Coating Solvent | Concentration | Rsistivity (μΩ cm) | Thickness (Å) | Adhesion (mN) |
|---|---|---|---|---|---|---|---|
| Example 1 | $Ag(CF_3COO)CH_3CONHNH_2$ | 3-aminopropyl trimethoxy silane | MeCN | 1.5M | 2.5 | 2000 | 100 |

TABLE 1-continued

| | Organometallic Precursor Compound | Main Group Metal Compound | Coating Solvent | Concentration | Rsistivity (μΩ cm) | Thickness (Å) | Adhesion (mN) |
|---|---|---|---|---|---|---|---|
| Example 2 | $Ag(CF_3COO)$t-butylcarbazate | Sn(II)2-ethylhexanoate | MeCN | 1.5M | 3.3 | 1853 | 100 |
| Comp. Example 1 | $Ag(CF_3COO)CH_3CONHNH_2$ | — | MeCN | 1.5M | 2.5 | 2000 | 30 |
| Comp. Example 2 | $Ag(CF_3COO)$t-butylcarbazate | — | MeCN | 1.5M | 3.29 | 1853 | 30 |

Example 3

Figure 6A:
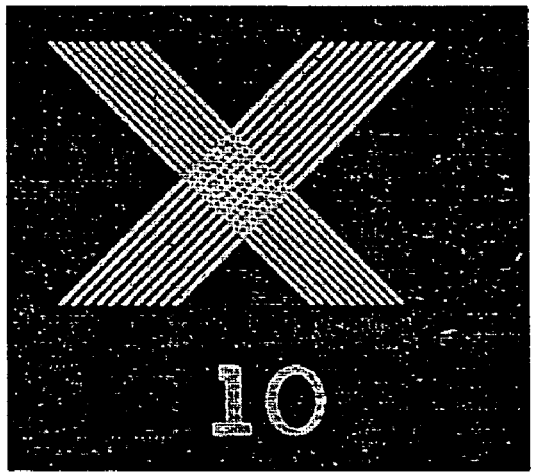
FIGS. 6(*a*) to 6(*c*) are electron microphotographs of the metal film treated in air condition obtained from Example 3.
Figure 6B:
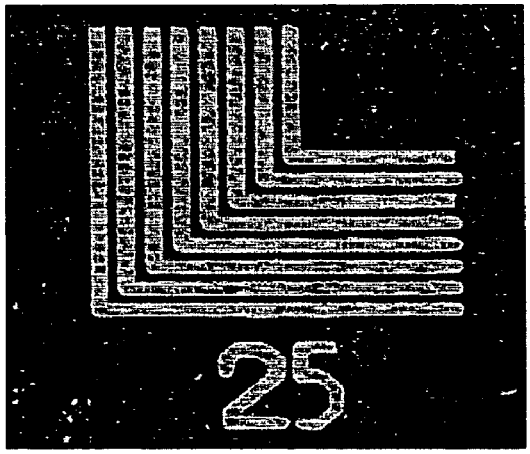
Figure 6C:
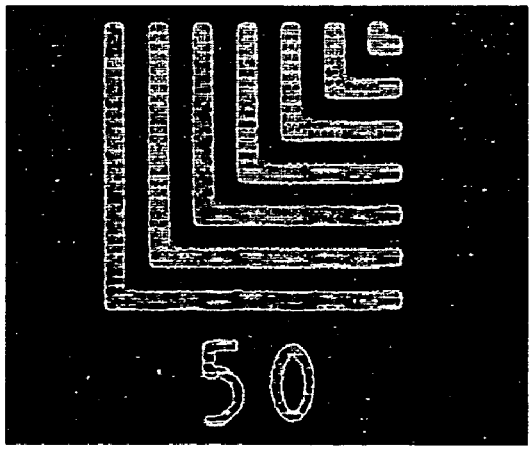

Pattern Formation by Using UV Light $Ag(CF_3COO)CH_3CONHNH_2$ obtained from Preparation Example 1) and 3-aminopropyl trimethoxy silane are dissolved in MeCN and diluted to a concentration of 1.5 M. The ratio of 3-aminopropyl trimethoxy silane is 2.0 parts by mole to 100 parts by mole of $Ag(CF_3COO)CH_3CONHNH_2$. The solution is spin-coated on a glass substrate and the coating film is exposed through a mask having a predetermined pattern using irradiator emitting UV and heat (manufactured by Oriel Co., 1 KW, UV broad band) for 200 seconds. The exposed film is developed by MeCN, and washed with IPA. The resulting patterns having 10 μm, 25 μm and 50 μm line width are illustrated in FIGS. 6(*a*) to 6(*c*).

Example 4-8

Each of the organometallic precursors obtained from Preparation Examples 3)-7) is dissolved in MeCN together with trimethoxy silane in order to obtain the solution of the composition of the following Table 2. The ratio of 3-aminopropyl trimethoxy silane is 2.0 parts by mole to 100 parts by mole of the organometallic precursor. The solution is spin-coated on the substrate followed by irradiation of UV light using 600 W UV irradiator for 200 sec. The coating film is then heat-treated at 300° C. for 5 min to form a metal film. The morphology of the surface of the film is similar to that of the film shown in FIG. 1. The thickness and resistivity of the metal film are measured using an alpha-step and a four-point probe, and the adhesion is measured using a scratch tester. The results are illustrated in Table 2.

Although a few preferred embodiments of the present invention are shown and described, it should be understood that changes may be made in these embodiments without departing from the spirit and scope of the invention.

What is claimed is:

1. A composition for forming a metal film or pattern, which comprises (i) an organometallic precursor represented by the following Formula 1 and (ii) an organometallic compound of a main group metal not represented by the following Formula 1:

$$L_nM_mL'_pX_q \qquad \text{Formula 1}$$

wherein,

M is a transition metal;

L' is a neutral ligand;

X is an anion that may or may not coordinate to the transition metal;

m is an integer of 1 to 10, provided that when m is two or more, each M is independently the same or different;

n is an integer of 1 to 40, provided that when n is two or more, each L is independently the same or different;

p is an integer of 0 to 40;

q is an integer of 0 to 10, provided that when p or q is two or higher, each L' or each X is independently the same or different, and p and q are not zero at the same time; and L is a hydrazine compound coordinating with the transition metal, and is represented by the following Formula 2:

$$R_1R_2NNR_3R_4 \qquad \text{Formula 2}$$

wherein, $R_1$, $R_2$, $R_3$ and $R_4$ are independently hydrogen, $C_1$~$C_{20}$ alkyl group, $C_1$~$C_{20}$ aryl group, or

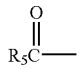

TABLE 2

| | Organometallic Precursor Compound | Main Group Metal Compound | Coating Solvent | Concentration | Rsistivity (μΩ cm) | Thickness (Å) | Adhesion (mN) |
|---|---|---|---|---|---|---|---|
| Example 4 | $Ag(CF_3COO)$benzoi hydrazide | 3-aminopropyl trimethoxy silane | Acetone: MeCN (1:1) | 1.0M | 306 | 2053 | 90 |
| Example 5 | $Ag(BF_4)CH_3CONHNH_2$ | | MeCN | 1.5M | 13.2 | 2053 | 95 |
| Example 6 | $Ag(SO_3CF_3)CH_3CONHNH_2$ | | MeCN | 1.5M | 143 | 3010 | 70 |
| Example 7 | $Ag(SbF_6)CH_3CONHNHNH_2$ | | MeCN | 1.5M | 150 | 2200 | 74 |
| Example 8 | $Ag(NO_3)CH_3CONHNH_2$ | | MeCN | 1.5M | 5 | 2005 | 83 |

[in which, $R_5$ is R', $R'_2N$, or R'O (wherein R' is hydrogen, or $C_1$~$C_{20}$ alkyl or aryl group)], provided that the alkyl and aryl group may or may not have one or more substituent which is selected from the group consisting of halogen, amine group, —OH, —SH, —CN, —$SO_3H$, $R_6S$—, $R_6O$—,

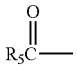

and nitrile groups (in which, $R_5$ is defined as above and $R_6$ is $C_1$~$C_{20}$ alkyl or aryl group).

2. The composition according to claim 1, wherein the ratio of the organometallic compound of a main group metal is 0.01 to 10 parts by mole based on the 100 parts by mole of the metal in the organometallic precursor.

3. The composition according to claim 1, wherein the organometallic compound of a main group metal is a $C_1$~$C_{30}$ organometallic compound containing a Si, Ge, Sn, or Bi atom.

4. The composition according to claim 3, wherein the organometallic compound of the main group metal has a functional group containing N, O, S, P or halogen atom.

5. The composition according to claim 1, wherein M is at least one metal selected from the group consisting of Ag, Au, Cu, Pd, Pt, Os, Ph, Co, Ni, Cd, Ir, and Fe; L' is a compound having 20 or fewer carbon atoms containing donor atoms such as N, P, As, O, S, Se and Te; and X is at least one anion that may or may not coordinate with the metal atom, the anion being selected from the group consisting of $OH^-$, $CN^-$, $NO_2^-$, $NO_3^-$, halide ($F^-$, $Cl^-$, $Br^-$, or $I^-$), trifluoroacetate, isothiocyanate, tetraalkylborate ($BR_4^-$, R is Me, Et or Ph), tetrahaloborate ($BX_4^-$, X is F or Br), hexafluoro phosphate ($PF_6^-$), triflate ($CF_3SO_3^-$), tosylate ($Ts^-$), sulphate ($SO_4^{2-}$) carbonate ($CO_3^{2-}$) acetylacetonate, trifluoroantimonate ($SbF_6^-$), and hydrazine group containing anions.

6. The composition according to claim 5, wherein L' is selected from the group consisting of amines; alcohols; phosphines, phosphites and phosphine oxides; arsines; thiols; carbonyl compounds; alkenes; alkynes; and arenes.

7. The composition according to claim 1, wherein the organometallic precursor represented by the Formula 1 is $Ag(CF_3COO)CH_3CONHNH_2$, $Ag(CF_3COO)$t-butylcarbazate, $Ag(CF_3COO)$t-benzoichydrazide, $Ag(BF_4)CH_3CONHNH_2$, $Ag(SbF_6)CH_3CONHNH_2$, $Ag(SO_3CF_3)CH_3CONHNH_2$, or $Ag(NO_3)CH_3CONHNH_2$.

8. The composition according to claim 1, wherein the organometallic compound of the main group metal is $(RO)_3Si(CH_2)_nNH_2$ (in which R is a methyl or ethyl group; and n is an integer of 1 to 10), tin(II)2-ethylhexanoate, germanium (IV)alkoxide or bismuth(III)acetate.

9. A process for forming a metal or metal oxide film comprising (i) preparing a solution with the composition according to claim 1 by dissolving it in a suitable solvent;

(ii) forming a film on a substrate; and (iii) heat-treating the film.

10. The process according to claim 9, further comprising exposing the film to UV light after the formation of the film and before the heat-treatment.

11. The process according to claim 9, wherein the solvent is selected from the group consisting of nitrile-based solvents including acetonitrile, propionitrile, pentanenitrile, hexanenitrile, heptanenitrile, and isobutylnitrile; aliphatic hydrocarbons including hexane, heptane, octane, and dodecane; aromatic hydrocarbons including anisole, mesitylene, and xylene; ketone-based solvents including methyl isobutyl ketone, 1-methyl-2-pyrrolidinone, cyclohexanone, and acetone; ether-based solvents including tetrahydrofuran, diisobutyl ether, and isopropyl ether; acetate-based solvents including ethyl acetate, butyl acetate, and propylene glycol methyl ether acetate; alcohol-based solvents including isopropyl alcohol, butyl alcohol, hexyl alcohol, and octyl alcohol; inorganic solvents; and mixtures thereof.

12. The process according to claim 9, wherein the heat treatment is performed at a temperature of 80 to 500° C., for 5 seconds to 10 minutes.

13. A process for forming a metal or metal oxide pattern comprising (i) preparing a solution of the composition according to claim 1 by dissolving it in a suitable solvent;

(ii) directly forming a pattern by forming the solution on a substrate; and (iii) heat-treating the pattern.

14. The process according to claim 13, further comprising exposing the pattern to UV light after the formation of the pattern and before the heat-treatment.

15. The process according to claim 13, wherein the solvent is selected from the group consisting of nitrile-based solvents including acetonitrile, propionitrile, pentanenitrile, hexanenitrile, heptanenitrile, and isobutylnitrile; aliphatic hydrocarbons including hexane, heptane, octane, and dodecane; aromatic hydrocarbons including anisole, mesitylene, and xylene; ketone-based solvents including methyl isobutyl ketone, 1-methyl-2-pyrrolidinone, cyclohexanone, and acetone; ether-based solvents including tetrahydrofuran, diisobutyl ether, and isopropyl ether; acetate-based solvents including ethyl acetate, butyl acetate, and propylene glycol methyl ether acetate; alcohol-based solvents including isopropyl alcohol, butyl alcohol, hexyl alcohol, and octyl alcohol; inorganic solvents; and mixtures thereof.

16. The process according to claim 13, wherein the direct formation of the pattern is performed by microcontact printing, micromolding in capillary (MIMIC), solvent-assistance micromolding, imprinting, ink-jet printing, or silk-screen.

17. The process according to claim 13, wherein the heat treatment is performed at a temperature of 80 to 500° C., for 5 seconds to 10 minutes.

18. A process for forming a metal or metal oxide pattern comprising (i) preparing a solution of the composition according to claim 1 by dissolving it in a suitable solvent;

(ii) forming a film on a substrate;

(iii) selectively heat-treating the film under a patterned mask; and (iv) developing the film to form a pattern.

19. The process according to claim 18, wherein the solvent is selected from the group consisting of nitrile-based solvents including acetonitrile, propionitrile, pentanenitrile, hexanenitrile, heptanenitrile, and isobutylnitrile; aliphatic hydrocarbons including hexane, heptane, octane, and dodecane; aromatic hydrocarbons including anisole, mesitylene, and xylene; ketone-based solvents including methyl isobutyl ketone, 1-methyl-2-pyrrolidinone, cyclohexanone, and acetone; ether-based solvents including tetrahydrofuran, diisobutyl ether, and isopropyl ether; acetate-based solvents including ethyl acetate, butyl acetate, and propylene glycol methyl ether acetate; alcohol-based solvents including isopropyl alcohol, butyl alcohol, hexyl alcohol, and octyl alcohol; inorganic solvents; and mixtures thereof.

20. The process according to claim 18, wherein the heat-treatment is performed at a temperature of 80 to 500° C., for 5 seconds to 10 minutes.

21. The process according to claim 18, wherein the heat-treatment under the patterned mask is performed with IR, UV, laser or E-beam.

22. The film obtained by the process according to claim 9.

23. The pattern obtained by the process according to claim 13.

24. The pattern obtained by the process according to claim 18.

25. A film or pattern obtained from a composition comprising (i) an organometallic precursor represented by the following Formula 1 and (ii) an organometallic compound of a main group metal not represented by the following Formula 1:

$$L_nM_mL'_pX_q \qquad \text{Formula 1}$$

wherein,

M is a transition metal;

L' is a neutral ligand;

X is an anion that may or may not coordinate to the transition metal;

m is an integer of 1 to 10, provided that when m is two or more, each M is independently the same or different;

n is an integer of 1 to 40, provided that when n is two or more, each L is independently the same or different;

p is an integer of 0 to 40;

q is an integer of 0 to 10, provided that when p or q is two or higher, each L' or each X is independently the same or different, and p and q are not zero at the same time; and L is a hydrazine compound coordinating with the transition metal, and is represented by the following Formula 2:

$$R_1R_2NNR_3R_4 \qquad \text{Formula 2}$$

wherein, $R_1$, $R_2$, $R_3$ and $R_4$ are independently hydrogen, $C_1$~$C_{20}$ alkyl group, $C_1$~$C_{20}$ aryl group, or

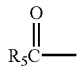

[in which, $R_5$ is R', $R'_2N$, or R'O (wherein R' is hydrogen, or $C_1$~$C_{20}$ alkyl or aryl group)], provided that the alkyl and aryl group may or may not have one or more substituent which is selected from the group consisting of halogen, amine group, —OH, —SH, —CN, —$SO_3H$, $R_6S$—, $R_6O$—,

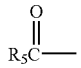

and nitrile groups (in which, $R_5$ is defined as above and $R_6$ is $C_1$~$C_{20}$ alkyl or aryl group).

* * * * *